US005841052A

United States Patent [19]

Stanton

[11] Patent Number: 5,841,052

[45] Date of Patent: Nov. 24, 1998

[54] FINGER PLAYABLE PERCUSSION TRIGGER INSTRUMENT

[75] Inventor: Francis S. Stanton, 50 Merlham Dr., Madison, Wis. 53705

[73] Assignee: Francis S. Stanton, Madison, Wis.

[21] Appl. No.: 863,817

[22] Filed: May 27, 1997

[51] Int. Cl.[6] ..... G10D 13/00; G10D 13/02

[52] U.S. Cl. ..... 84/600; 84/743; 84/107; 84/113

[58] Field of Search ..... 84/600, 743, 104, 84/105, 107, 113, 293

[56] References Cited

U.S. PATENT DOCUMENTS

| | | | |
|---|---|---|---|
| 4,867,028 | 9/1989 | Jones | 84/735 |
| 4,924,741 | 5/1990 | Vollenwieder | 84/730 |
| 5,115,706 | 5/1992 | Alvisi | 84/723 |
| 5,403,972 | 4/1995 | Valentine, Sr. | 84/730 |
| 5,434,350 | 7/1995 | Haney et al. | 84/743 |

OTHER PUBLICATIONS

PAIA catalog 1996 pp. 8–9.

Down Beat Magazine Dec. 1991 p. 14 Article on Roy Wooton by Bill Milkowski.

*Primary Examiner*—William M. Shoop, Jr.

*Assistant Examiner*—Marlon T. Fletcher

[57] ABSTRACT

A portable musical instrument capable of triggering a percussion synthesizer by striking of fingers on a plurality of transducers. The ergonomic shape of the instrument is similar to a guitar, with a set of transducers on the body for one hand and another set of transducers on a rotated head for the other hand. The arrangement of transducers is placed so that minimal finger travel is necessary to play a variety of sounds rapidly and comfortably. Transducers are plugged into to a configurable central circuit board assembly in the body, which are in turn is connected by cable to a percussion synthesizer interface box. The interface box is connected to a percussion synthesizer by standard 1/4" phone plug cables. Certain transducers and switches control additional parameters of a percussion synthesizer including hi-hat position and patch selection.

14 Claims, 6 Drawing Sheets

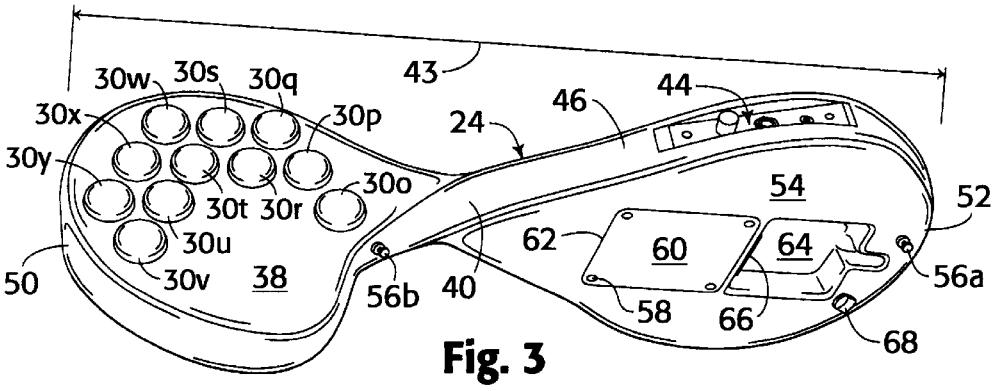
Fig. 3
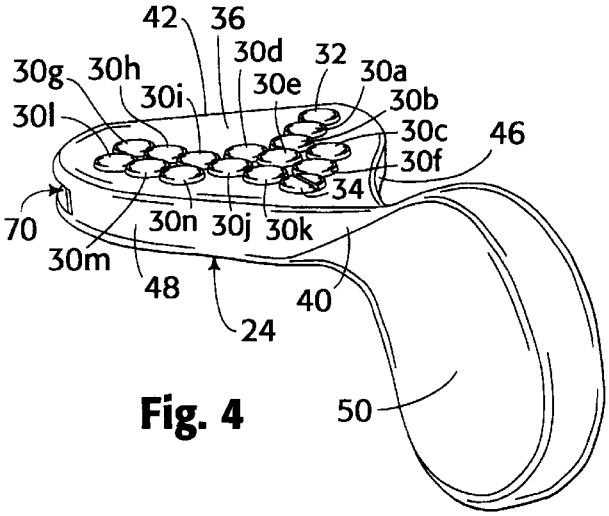
Fig. 4
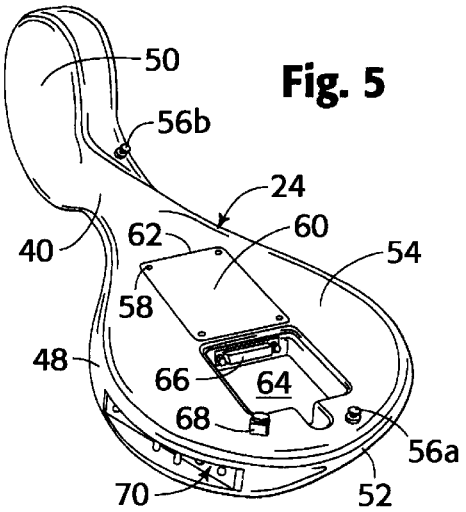
Fig. 5
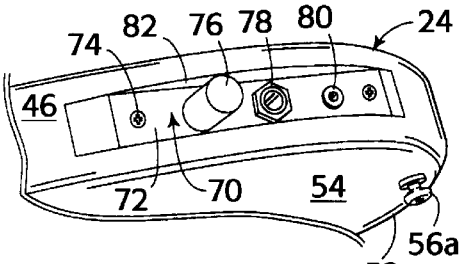
Fig. 6
Fig. 7
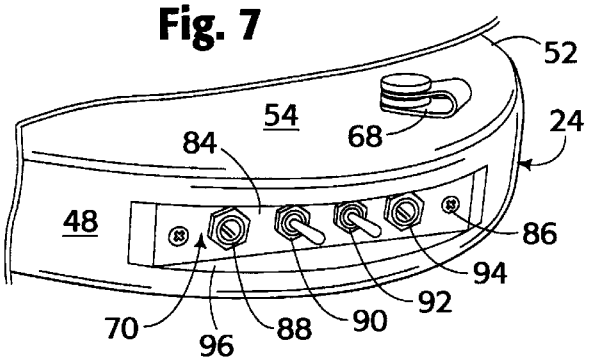

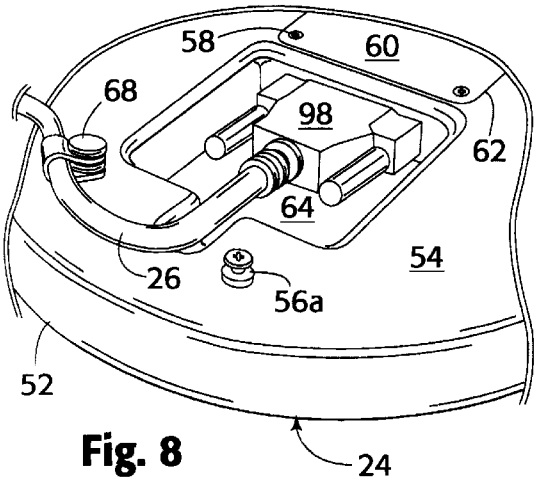
Fig. 8
Fig. 9
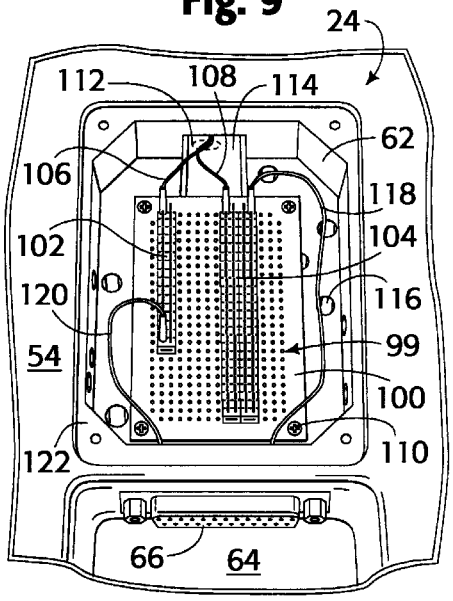
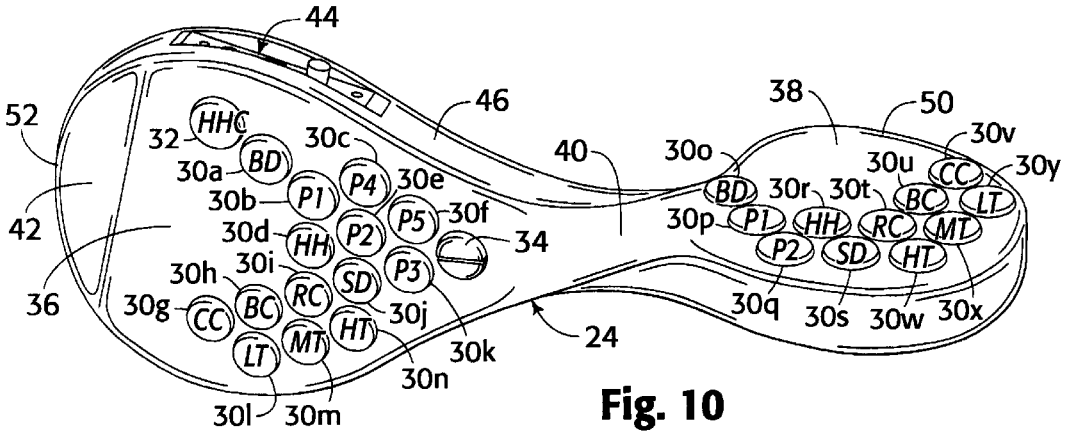
Fig. 10

FINGER PLAYABLE PERCUSSION TRIGGER INSTRUMENT

BACKGROUND

1. Field of Invention

The present invention is in the field of electronic musical instruments and is an improved portable percussion trigger instrument for use with electronic percussion synthesizers.

2. Discussion of Prior Art

In the long history of drum playing, many types of drum and percussion instruments have been developed for particular forms of music. Until recently acoustic instruments were predominant; electronically produced drum and percussion sounds were available, but not widely used.

In recent years, a number of commercially available percussion synthesizers have become available. In this time period, the sound quality of electronic percussion has improved so that now drum and percussion sounds are very realistic, and used for artistic and commercial purposes. The development of the Musical Instrument Digital Interface (MIDI) standard has helped considerably with communication between keyboard and percussion synthesizers.

Early percussion synthesizers used momentary switches to actuate sounds. The majority of recent percussion synthesizers use as a trigger input the common piezoelectric transducer. A piezoelectric transducer, when struck, creates a small voltage spike from the vibrations, which in turn is sensed by a percussion synthesizer, which then produces a sound. Most percussion synthesizers can also sense the amplitude of the spike, and vary the sound output in proportion to the velocity of the striking force. This gives a more realistic sound. Inputs on these percussion synthesizers allow a number of piezoelectric transducer triggers, usually as large pads for hitting with drumsticks, to be attached to suit the individual preferences of the drummer.

A problem with piezoelectric transducer triggers is their susceptibility to be triggered by vibrations from other hits on adjacent piezoelectric transducers (crosstalk), thus triggering an unintended sound from the percussion synthesizer. Piezoelectric transducer triggers can produce a sufficient voltage to actuate with a softer hit, so the crosstalk effect can be reduced by using just finger force. A few drum machines accept inputs from force sensitive resistor transducers, which do not have a crosstalk problem. Some inputs also serve as a controller for other inputs by using a foot pedal with a variable resistor.

In addition, many percussion synthesizers can hold groups or setups of sounds together as "patches", similar to a set of drums. A creative drummer can assemble a number of different sounding drum and percussion patches, each with a different patch name or number, and these patches can usually be changed while playing with the use of a footswitch.

Acoustic drums and percussion, while producing a real sound and being a genuine pleasure to play, have some drawbacks. Conventional drums sets and many percussion instruments are heavy and cumbersome, and require setup at remote performance locations. Setup and breakdown time for extensive drumsets can take hours. Transport requires planning.

In addition, in many concert situations, microphones and a loudspeaker system are required so the audience can hear the drums along with the other amplified instruments. Microphone placement for drums and percussion can be complicated to faithfully reproduce the drum sounds in their proper balance with each other and the other instruments. With percussion synthesizers, careful programming can set individual drum, cymbal and other percussion sounds at their proper levels, and be recalled for repeated use quickly. The overall sound level of the percussion synthesizer can be set suitable to the size of the audience, and the type of music being played as well.

The hands, fingers and feet are the primary tools of most of the world's drummers. Fingers are used in hand drum playing to add quieter tones and nuance to the drum rhythm pattern. Sticks and other devices add reach, rapid bounce, and their own timbre when striking the drum or cymbal.

Also, playing the drums often involves great speed to hit various parts of the drumset in rapid succession. It can be difficult to maintain these gross arm movements for extended periods of time.

Furthermore, in many music performances, some musicians are able to roam the stage, while others, including keyboardists and drummers, are usually fixed in one place by their instruments. In recent years, several portable keyboards have been developed which allow freedom of movement. It is possible with a MIDI-equipped synthesizer to play the drums by striking a standard keyboard. With this method, it is very difficult to attain good speed and stamina because of the linear arrangement of the keys and close proximity of one key to the next.

A few drum trigger units have been made in prior art which have attempted to address the needs for portability, speed and ease of play, programmability, and for stage movement. Several of these inventions are found in U.S. patents to Jones (U.S. Pat. No. 4,867,028), Valentine, Sr. (U.S. Pat. No. 5,403,972) and Haney et al. (U.S. Pat. No. 5,434,350).

In the Jones patent, two pressure-sensitive trigger pads are mounted on a guitar shaped body so as to be played by the opposing thumb and finger of one hand, while the other hand pushes buttons on a keypad on the neck to select the sounds to be played. The playing technique would require the user to change drum sounds rapidly and in the proper order to play a rhythm. This playing method, while novel, may not be familiar and comfortable to a experienced percussionist.

Drummer Roy Wooton, of the musical group Bela Fleck and the Flecktones, invented a percussion instrument in the 1980's and continues to play it today. It is not commercially produced. His instrument has a unique physical arrangement of piezoelectric transducers and pressure sensitive resistors mounted on a Synthaxe™ electronic guitar body. His creative, accomplished, and personal playing technique is well matched to the design and construction of his instrument. One of the outstanding features of this instrument is the small amount of hand and finger motion required to play very rapid and complex rhythm patterns.

The Valentine, Sr. patent shows a guitar shaped instrument with a plurality of rectangular trigger pads mounted on the body and neck. Although the trigger pads appear to be large enough to strike easily with the fingers, their arrangement would seem to limit a rapid and facile movement of the hand or fingers to strike the next trigger pad. Also, the embodiment shows only eight trigger pads whereas current percussion synthesizers can accommodate more, thus limiting the potential palette of sounds available at one time.

Both the FingerDrum and the ThumbDrum are commercial electronic kits available from PAIA Electronics of Edmond, OK. These consist of a table top box with ten or eight piezoelectric: transducer triggers, repectively, and an optional programmable MIDI computer or sound generating circuit. On the FingerDrum the arrangement of the piezoelectric transducers corresponds to the location of the fingertips of both average-sized hands laying flat. This arrangement allows a rapid, natural and relaxed hand position while playing a particular sound. The ThumbDrum has a different piezoelectric transducer trigger arrangement for one-handed use. These kits, with additional effort, could be mounted on a suitable instrument body.

The Haney et al. patent is commercially available as the Zendrum and is triangular in shape with 24 piezoelectric transducer triggers on the front connected to an internal trigger-to- MIDI computer. The instrument is played with both hands moving and striking the piezoelectric transducers located over much of the face of the body. The arrangement of piezoelectric transducers, while plentiful, is spread out and seems to often require a rapid and accurate hand and finger motion across the face of the instrument to strike the next trigger, as in the Valentine, Sr. patent. The trigger-to-MIDI computer also requires a power supply and some additional user programming to connect to a percussion synthesizer.

Consequently, a need exists for an instrument which combines the above qualities of portability and overall movement, comfort and ease of play with a relaxed and relatively static hand position, crosstalk reduction, and versatility of arrangement of sounds with a lack of additional programming.

OBJECTS AND ADVANTAGES

Accordingly, several objects and advantages of the present invention are:

to provide a portable, mandolin-sized percussion trigger instrument which is comfortable to hold and wear in either a standing, sitting or table top position;

to provide a percussion trigger instrument which allows an improved method of producing realistic percussion sounds superior to those methods proposed in the prior art, which is playable with either one or two hands, and which allows simultaneous playing of a plurality of sounds;

to provide a percussion trigger instrument which reduces the amount of crosstalk between triggers, and allows the physical switching and replacement of triggers; and to provide a trigger instrument which plugs directly into and is compatible with a variety of percussion synthesizers, and which has a configurable trigger-to-sound assignment ability.

Further objects and advantages are to provide a percussion trigger instrument which provides external inputs for foot controls and triggers, which allows control of percussion synthesizer patches, and which allows control of a hi-hat sound in percussion synthesizers so equipped.

Still further objects and advantages will become apparent from a consideration of the drawings and ensuing description. It should be understood that the drawings are for illustration and description and are not intended as a definition of the limits of the invention.

DRAWING FIGURES

FIG. 3 shows a top rear view of the preferred embodiment of the present invention.

FIG. 4 shows a bottom head-end view of the preferred embodiment of the present invention.

FIG. 5 shows a bottom tail-end view of the preferred embodiment of the present invention.

FIG. 6 shows a top rear view of the headphone monitor panel of the preferred embodiment of the present invention.

FIG. 7 shows a bottom side view of the foot transducer connector panel of the preferred embodiment of the present invention.

FIG. 8 shows a bottom tail-end view of the connecting cable cavity of the preferred embodiment of the present invention.

FIG. 9 shows a bottom view of the internal circuit board of the preferred embodiment of the present invention.

FIG. 10 shows a top front view of the preferred embodiment of the present invention showing the preferred arrangement of transducer triggers by sounds produced.

Figure 19:
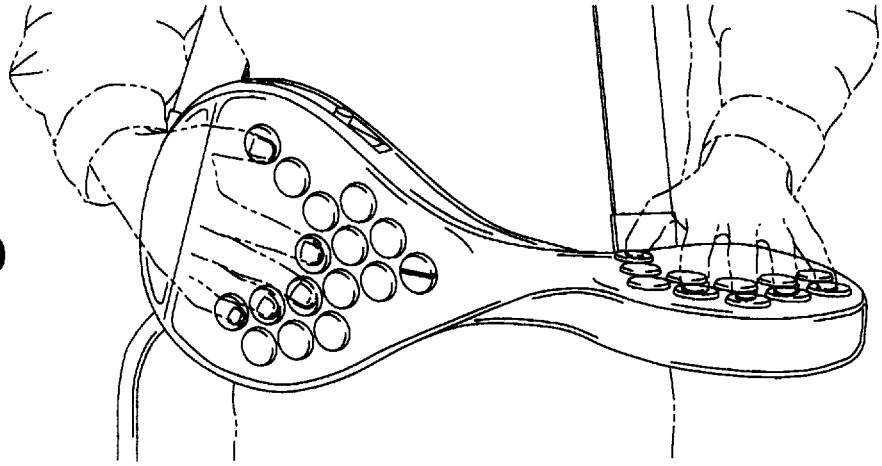
Figure 20:
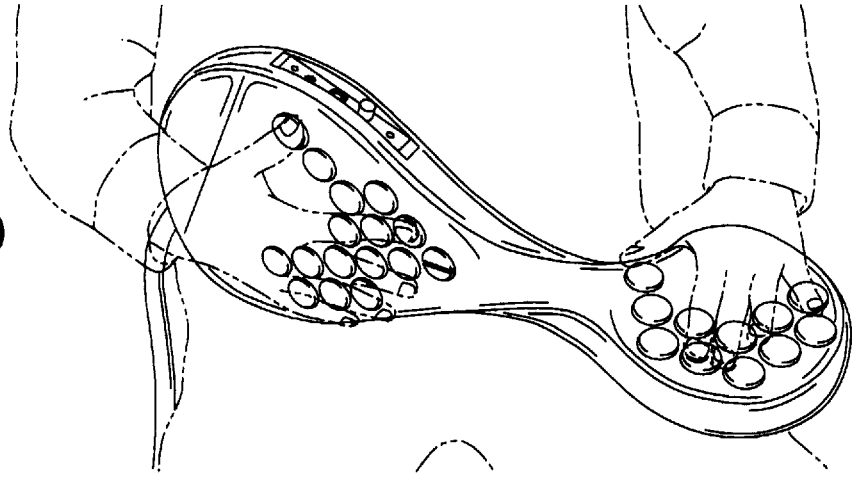
Figure 21:
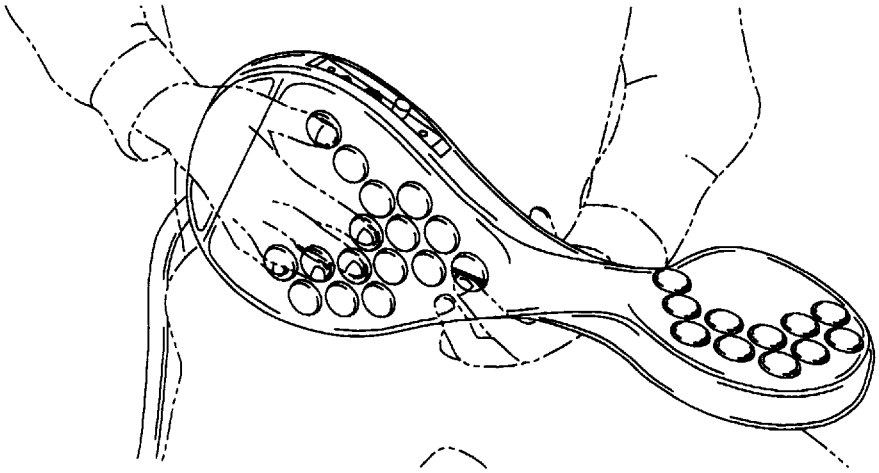

FIGS. 19–21 each show hand positions for playing the preferred embodiment of the present invention.

REFERENCE NUMERALS IN DRAWINGS

24 instrument body
25 percussion synthesizer interface box
26 connecting cable
27 foot transducer trigger
28 foot transducer wire
30*a*–30*y* piezoelectric transducer triggers
32 force sensitive resistor transducer trigger
34 percussion synthesizer patch change switch
35 3-conductor wire
36 right-hand playing surface
38 left-hand playing surface
40 neck
42 bevel
43 approximate overall dimension
44 headphone monitor panel
46 top edge
48 bottom edge
50 head

52 tail
54 back
56*a*–56*b* shoulder strap posts
58 screws
60 removable panel
62 interior cavity
64 cable cavity
66 female cable connector
68 connector cable strap
70 foot transducer connector panel
72 headphone monitor mounting panel
74 mounting screws
76 headphone volume control
78 ¼" stereo headphone jack
80 ⅛" stereo headphone jack
82 headphone monitor cavity
84 foot transducer connector mounting panel
86 mounting screws
88 ¼ 2-conductor hi-hat transducer jack
90 hi-hat transducer switch
92 bass drum transducer switch
94 ¼" 2-conductor bass drum transducer jack
96 foot transducer connector cavity
98 male cable connector
99 circuit board assembly
100 circuit board
102 pin jacks for ground
104 pin jacks for positive
106 transducer ground wire and plug
108 transducer positive wire and plug
110 mounting screws
112 transducer wires
114 neck channel
116 wiring tunnel
118 connector cable positive wire and plug
120 connector cable ground wire and plug
122 removable cover recess
124 piezoelectric transducer
126 thin adhesive
128 rigid cap
130 glue
132 resilient support member
134 cylindrical well
136 shim
138 force sensitive resistor
140 resilient foam central core
142 softer foam donut
144 slug
146 spacer
148 solder
150 2-conductor wire
151 3-conductor wire
152 transducer
154 protective casing
156*a*–156*b* hook and pile material straps
158 ¼" 2-conductor transducer plug
160 female cable connector
162 ¼" 2-conductor phone jack
164 ⅛" 3-conductor headphone monitor jack
166 ¼" 3-conductor headphone monitor jack
168 ¼" 3-conductor footswitch jack
170 ¼" 2-conductor hi-hat control jack
172 ¼" 2-conductor phone cord
174 ¼" 3-conductor phone cord

SUMMARY

The present invention provides a percussion trigger instrument which is connectable to a common percussion synthesizer for comfortable and improved playing.

DESCRIPTION—FIGS. 1 to 18

Figure 1:
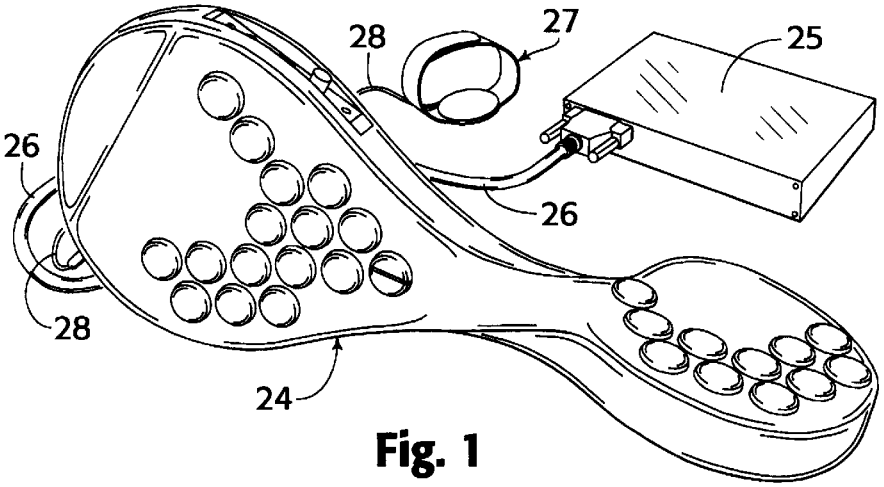
FIG. 1 shows a top front view of the preferred embodiment of the present invention including components and connections.

FIG. 1 shows a perspective view of the percussion trigger instrument in its preferred embodiment. The instrument includes an instrument body 24 connected to a percussion synthesizer interface box 25 by a connecting cable 26. A foot transducer trigger 27 is attached to instrument body 24 by a foot transducer wire 28. The division of the percussion trigger instrument into instrument body 24 and interface box 25 allows an easier connection of the instrument to a percussion synthesizer (not shown) with just one wire connected to the performer.

The preferred embodiment of instrument body 24 is shown in FIGS. 2–5. Piezoelectric transducer triggers 30*a*–30*n* are mounted on a right-hand playing surface 36 on instrument body 24 and piezoelectric transducer triggers 30*a*–30*y* are mounted on a left-hand playing surface 38 located on a head 50. A neck 40 makes a twist to link right-hand playing surface 36 and left-hand playing surface 38. Both a force sensitive resistor transducer trigger 32 and a percussion synthesizer patch change switch 34 are located on surface 36. The transducer triggers in aggregate for each hand are arranged in a closest-packing pattern. This is believed to be most efficient for rapid playing of percussion sounds while minimizing finger travel. This closest packing arrangement is superior to both a standard linear piano keyboard and a widely spaced transducer arrangement because the player's hand needs only a relatively small movement for the fingers to reach the next trigger. The overall size of each hand's transducer trigger aggregate is believed to fit all but the largest and smallest person's hands.

Percussion synthesizer patch change switch 34 includes two SPST momentary switches which allow for bidirectional scrolling through the percussion synthesizer patches, if the percussion synthesizer has this feature. A 3-conductor wire 35 connects switch 34 with circuit board assembly 99 shown in FIG. 18. If the percussion synthesizer has a single direction scroll, then one of the switches would work while the other has no effect. Switch 34 has a benefit in that a performing musician can choose a new percussion synthesizer patch without having to walk over to the percussion synthesizer, and may even be able to accomplish this during a song for a varied musical effect.

It should be noted that the exclusion of an internal trigger-to-MIDI computer reduces the weight and cost of the present invention. An internal trigger-to-MIDI computer would most likely be a duplication of circuitry already present on most percussion synthesizers.

A bevel 42 located adjacent to a tail 52 allows for a more comfortable rest for the heel of the player's right hand. While size is not, per se, a limitation on the practice of the present invention, it is felt that the overall dimension from tail 52 to the opposite end of head 50 would be in the vicinity of 56 cm (22") as referenced by 43 in FIG. 3.

A headphone monitor panel 44 is located within a top edge 46 of instrument body 24. On a back 54 is a shoulder strap post 56*a* for attaching the end of a standard guitar shoulder strap to the preferred embodiment. A shoulder strap post 56*b* is mounted on neck 40 for the other end of the guitar strap. Four screws 58 secure a removable panel 60 over an interior cavity 62. Removable panel 60 permits access to wiring inside interior cavity 62. Adjacent to interior cavity 62 is a cable cavity 64 which protects connecting cable 26. Connecting cable 26 is attached to a female cable connector 66 when the unit is in operation, and disconnects for travel. A connector cable strap 68 is secured next to cable cavity 64 and relieves strain on connecting cable 26. A foot transducer connector panel 70 is located within a bottom edge 48 of instrument body 24.

Headphone monitor panel 44 is detailed in FIG. 6. On headphone monitor mounting panel 72 are located two mounting screws 74, a headphone volume control 76, a ¼" stereo headphone jack 78 and a ⅛" stereo headphone jack 80. Jacks 78 and 80 are wired in parallel. It is felt that having two sizes of headphone jacks available would be beneficial as headphone plugs can come in either of these two sizes. Headphone monitor mounting panel 72 and its attached components are located within a headphone monitor cavity 82. Having a jack built into instrument body 24 for a headphone allows one less cord to tangle.

Foot transducer connector panel 70 is detailed in FIG. 7. On a foot transducer connector mounting panel 84 are located two mounting screws 86, a ¼" 2-conductor hi-hat transducer jack 88, a hi-hat transducer switch 90, a bass drum transducer switch 92, and a ¼" 2-conductor bass drum transducer jack 94. Both switches allow the user to activate the respective foot transducers according to musical need, while leaving them attached. Panel 84 and its attached components are located within a foot transducer connector cavity 96. Normally, if the musician desires, one or two foot transducer triggers 27 could be attached to panel 70. Or a commercially available foot pedal suited to that particular percussion synthesizer could be used; these pedals commonly use a ¼" phone plug.

FIG. 8 shows more clearly cable cavity 64 and attached connecting cable 26 with intregal male cable connector 98. Cable cavity 64 has the advantage of allowing the instrument to lie flat against the drummer's body for a more relaxed right hand position, and provides protection for connecting cable 26.

FIG. 9 details the components within interior cavity 62. Centrally located within interior cavity 62 is a circuit board assembly 99, part of which is a circuit board 100 secured by four mounting screws 110. Attached to circuit board 100 are a plurality of pin jacks for ground 102 and pin jacks for positive 104 which accept a plurality of transducer ground wires and plugs 106 and transducer positive wires and plugs 108. The plurality of wires and plugs 106 and 108 are connected to a plurality of transducer wires 112 which in turn connect to piezoelectric transducer triggers 30*a*–30*y*, force sensitive resistor transducer trigger 32 and a percussion synthesizer patch change switch 34.

The abovementioned plurality of jacks 102, jacks 104, wires and plugs 106, and wires and plugs 108 allows the switching of triggers 30*a*–30*y*, trigger 32 and switch 34 to various locations on right-hand playing surface 36 and left-hand playing surface 38 to suit the needs of the player. This switching ability permits the user to make their own arrangements of fingers associated with particular sounds, and playing patterns independent of the programming on a percussion synthesizer. If the drummer wanted to switch the finger locations of any two drum sounds, for example, they could do this by switching the respective wire and plugs 108 on jacks 104.

It is important to note that transducer wires 112 are not necessarily polarized as to positive and ground, but good wiring practice suggests that the present invention be constructed observing consistent polarity. Percussion synthesizer patch change switch 34 wiring must observe proper polarity as the switch in the preferred embodiment allows for bidirectional scrolling through the percussion synthesizer patches, providing the percussion synthesizer is so equipped. Transducer wires 112 from triggers 30*o*–30*y* are routed through neck channel 114, or a plurality of wiring tunnels, a typical one which is indicated at 1 16. Instrument body 24 can be made in sections to form a neck channel 114 to accommodate transducer wires 112 inside neck 40.

From jacks 104, a connector cable positive wire and plug 118 is connected to the appropriate pin on female cable connector 66. From jacks 102 , a connector cable ground wire and plug 120 is connected to the appropriate pin on connector 66. For clarity in these drawings, most of the aforementioned wiring is omitted. A removable cover recess 122 holds removable cover 60 of FIG. 3.

FIG. 10 shows piezoelectric transducer triggers 30*a*–30*y* and force sensitive resistor transducer trigger 32 labeled by their preferred arrangement by the percussion sound they produce. As noted above, the present invention connects each of the transducer triggers to a particular sound in a patch in a percussion synthesizer. In the preferred embodiment, the set of sounds includes those of a standard trap drum set, including sounds of at least a bass drum, a snare drum, a high tom-tom, a medium tom-tom, a low tom-tom, a hi-hat cymbal, a hi-hat control (equivalent to a foot pedal), a ride cymbal, a ride cymbal bell, and a crash cymbal. The preferred embodiment includes two trap drum sets, one on right-hand playing surface 36 and the other on left-hand playing surface 38. With two drum sets at the drummer's disposal, they could accomplish a finger drum roll, for example, in a traditional alternating striking fashion, without excessive hand and finger movement. Miscellaneous percussion instrument sounds could be located on both playing surfaces 36 and 38.

An important aspect of the present invention is the arrangement of the various percussion sounds with respect to the player's finger positions. Primarily, the transducer triggers must be located as close together as possible without causing erroneous finger hits. To play a potentially rapid rhythm, it is vital that the hands and fingers remain relatively stationary, yet be able to move swiftly to a nearby transducer trigger at the appropriate moment. The situation is analageous to that of touch-typing finger movements. True speed and dexterity in playing the present invention will eventually occur with practice, and without the player needing to frequently look at the transducer triggers.

In FIG. 10, each of transducer triggers 30*a*–30*y* and 32 is marked with a two or three character label that indicates the sound produced when that particular transducer trigger is struck. These labels are defined in Table 1 below.

TABLE 1

| Label | Sound Produced |
|---|---|
| HHC | Hi-hat Control (pedal) |
| BD | Bass Drum |
| SD | Snare Drum |
| HH | Hi-hat Cymbal |
| HT | High Tom-tom |
| MT | Medium Tom-tom |
| LT | Low Tom-tom |
| RC | Ride Cymbal |
| BC | Ride Bell Cymbal |
| CC | Crash Cymbal |
| P1 | Miscellaneous Percussion Sound 1 |
| P2 | Miscellaneous Percussion Sound 2 |
| P3 | Miscellaneous Percussion Sound 3 |
| P4 | Miscellaneous Percussion Sound 4 |
| P5 | Miscellaneous Percussion Sound 5 |

It will be apparent to those experienced in the playing of drums and percussion that the present invention has an appeal and versatility for producing a wide variety or percussion sounds in a rapid and relatively straightforward manner.

Figure 11:
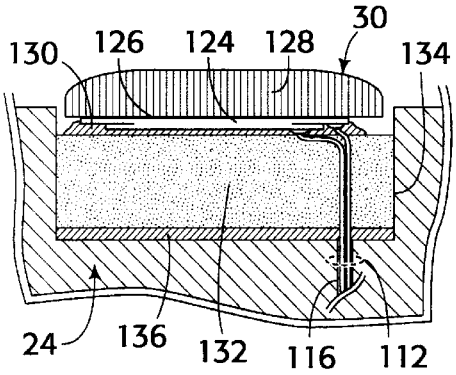
FIG. 11 shows a cross section of the preferred embodiment of the present invention of the piezoelectric transducer trigger.
Figure 12:
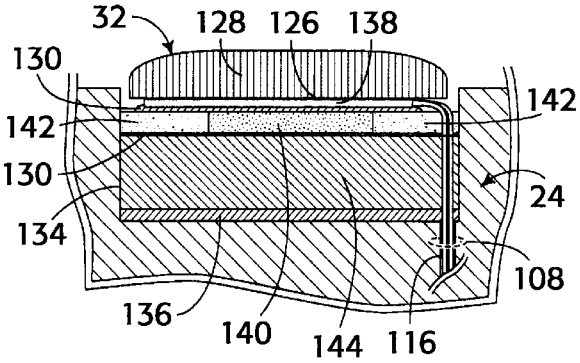
FIG. 12 shows a cross section of the preferred embodiment of the present invention of the force sensitive resistor trigger.

FIG. 11 is a cross section of a typical piezoelectric transducer trigger 30. A piezoelectric transducer 124 is conventional in nature and attached by a thin adhesive 126 such as contact cement to a rigid cap 128. A thin adhesive transmits vibration from rigid cap 128 to transducer 124 more readily than a thicker adhesive as tested by the inventor. Rigid cap 128 can be made of a number of materials, including metal, stone, glass and hard plastic, its diameter would be in the vicinity of 3 cm (1.25"). Transducer 124 is then in turn secured with glue 130 to a resilient support member 132, which is preferably made of neoprene or similar foam. Epoxy glue is recommended in the preferred embodiment due to its high strength and vibration damping qualities. Support member 132 is sized to fit tightly but without distortion in cylindrical well 134 within instrument body 24. A shim 136 of a determined thickness may be needed to elevate the abovementioned subassembly to the proper height relative to the playing surface of instrument body 24. Shim 136 may be made of a variety of materials including dense cardboard. Transducer wires 112 are routed through support member 132 and shim 136 to wiring tunnel 116. It can be seen that the combination of vibration absorbing foam, epoxy glue, physical separation of the striking surface from the instrument body, and a low striking force of a finger will reduce crosstalk significantly. FIG. 12 is a cross section of force sensitive resistor transducer trigger 32. A force sensitive resistor 138 is a device available from Interlink Electronics of Camarillo, Calif. which varies the electrical resistance as pressure is applied to the device. A relatively small amount of pressure is required to activate sufficient resistance to operate the hi-hat controller within a percussion synthesizer so equipped. Resistor 138 is attached securely by thin adhesive 126 to rigid cap 128. Resistor 138 is then in turn secured with glue 130 to a flat disk which is a combination of a resilient foam central core 140 surrounded by a softer foam donut 142. Foam core 140 is preferably made of neoprene or similar foam, and foam donut 142 is preferably made of a lightweight open cell foam. When cap 128 is pressed, the relatively stiffer foam core 140 pushes against and activates resistor 138 while softer foam donut 142 stabilizes rigid cap 128. The abovementioned subassembly is attached with glue 130 to a slug 144, preferably made of leather or hard rubber, which is sized to fit tightly but without distortion in cylindrical well 134 within instrument body 24. A shim 136 of a determined thickness may be needed to elevate the abovementioned subassembly to the proper height relative to the playing surface of instrument body 24. Transducer wires 112 are routed around slug 144 and shim 136 to wiring tunnel 116.

If either of transducer triggers 30 or transducer trigger 32 need replacement or a position change, they could be removed by repeatedly inserting a very thin, flat screwdriver along the edges of cylindrical well 134 and prying transducer triggers 30 and 32 upward in a gentle fashion.

Figure 2:
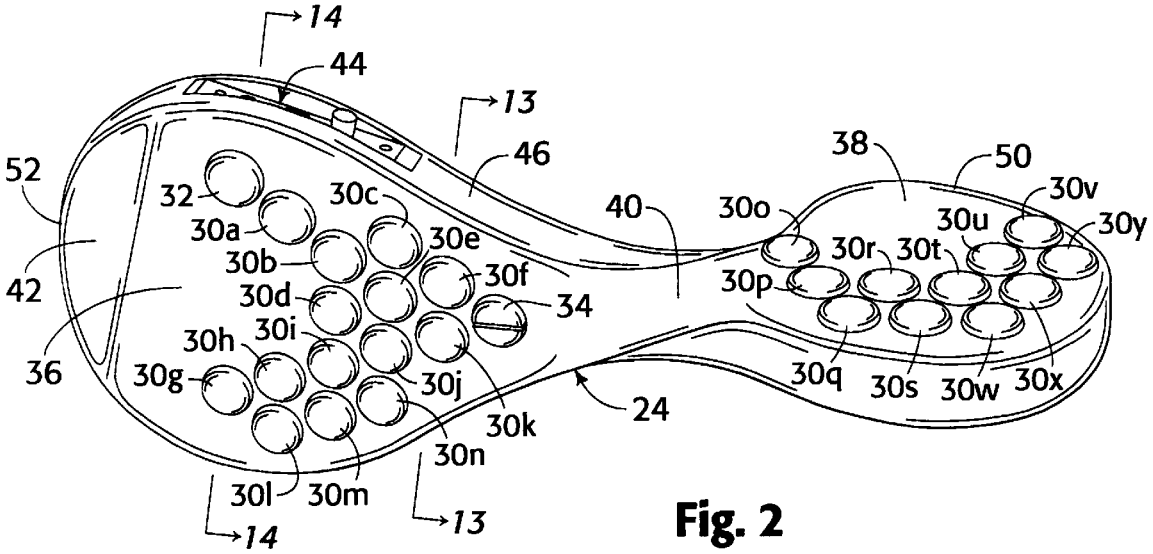
FIG. 2 shows a top front view of the preferred embodiment of the present invention.
Figure 13:
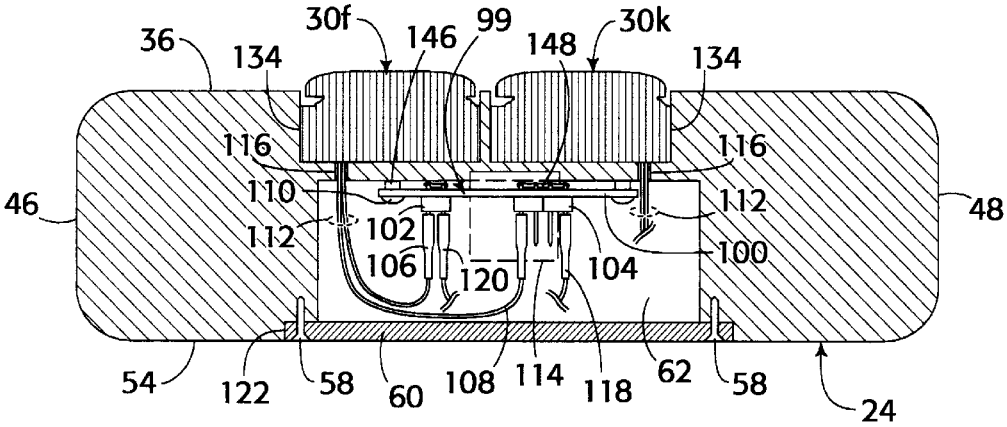
FIG. 13 shows a cross section of the preferred embodiment of the present invention along section line 13—13 in FIG. 2.

FIG. 13 shows a cross section taken along line 13—13 indicated in FIG. 2. From this view it is apparent how piezoelectric transducer triggers **30*f* and 30*k* are connected to circuit board 100. It should be understood that triggers 30*f* and 30*k* are shown only generally in cross section without the details evidenced in FIG. 11. In this view one can see more clearly the structure of pin jacks for ground 102 and pin jacks for positive 104, and transducer ground wires and plugs 106 and transducer positive wires and plugs 108. On the opposite side of circuit board 100, a bead of solder 148 connects lateral jacks 104 so the user can attach multiple trigger transducers for a single sound. Each lateral row of jacks 104 is electrically separate from one another. The plurality of jacks 102 are also connected on the same side of circuit board 100 by beads of solder 148, which creates a common ground for triggers 30*a*–30*y*. The electrical impulses created by a finger strike on transducer triggers 30 is passed through a plurality of solder beads 148 on jacks 102 and 104 on its way to the percussion synthesizer. Circuit board 100 is held away from instrument body 24 by spacers 146 and secured by mounting screws 110**.

Figure 14:
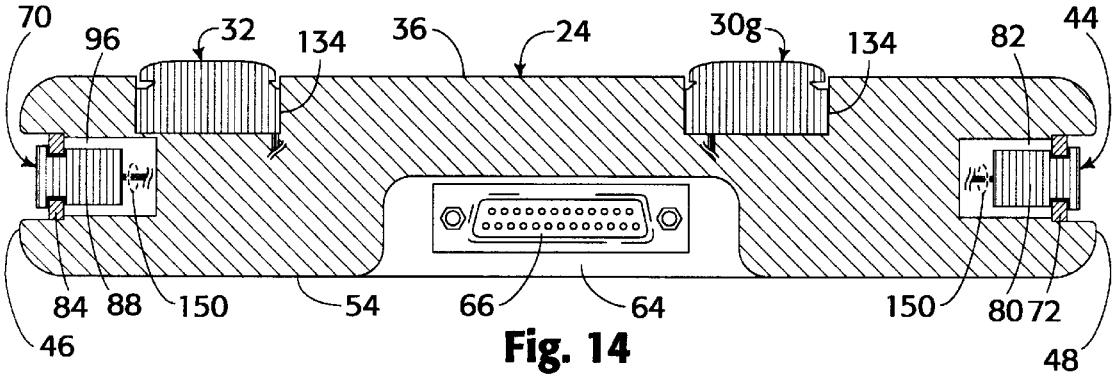
FIG. 14 shows a cross section of the preferred embodiment of the present invention along section line 14—14 in FIG. 2.

FIG. 14 shows a cross section taken along line 14—14 indicated in FIG. 2. This view details the structure of foot transducer connector panel 70 and headphone monitor panel 44. Respectively, 2-conductor wires 150 and 3-conductor wires 151 connect these components to circuit board 100 via wire tunnels 116, which are shown in FIG. 9. Both wires 150 and 151 terminate in plugs similar to those on wire and plugs 106.

Figure 15:
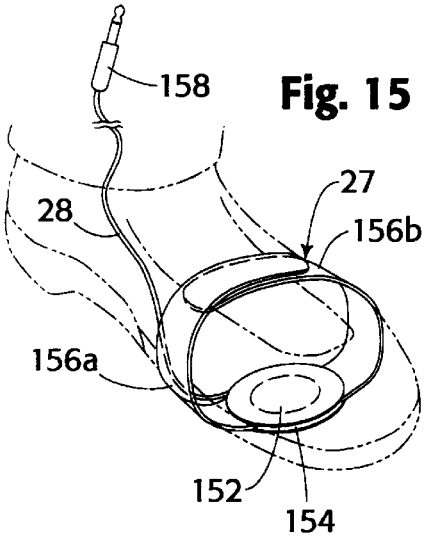
FIG. 15 shows a view of a foot transducer of the preferred embodiment of the present invention.

Referring to FIG. 15 which shows the construction and intended location of foot transducer trigger 27, it can be seen that a transducer 152 of either a piezoelectric type or a force sensitive resistor is encased in a protective casing 154. Extending from casing 154 are hook and pile material straps **156*a* and 156*b* made from a product such as Velcro™. Straps 156*a* and 156*b* hold foot transducer trigger 27 securely to the drummer's foot or shoe. In the preferred embodiment, casing 154 is made of disks of leather which are epoxied together so as to form into a unit including transducer 152, and straps 156*a* and 156*b* extending laterally outward. Foot transducer wire 28 is electrically connected to transducer 152 and extends approximately 30" and terminates in ¼" 2-conductor transducer plug 158. Wire 28 is intended to be run up and secured to the user's pant leg by a clip to be supplied by the user. Two of these foot transducer triggers 27 could be used if the musician so desired. One could be fitted with a piezoelectric transducer and connected to ¼" 2-conductor bass drum transducer jack 94 and used for the bass drum part, typically played with the right foot. The other could be fitted with a force sensitive resistor and connected to ¼" 2-conductor hi-hat transducer jack 88 and used for the hi-hat part, typically played with the left foot. These foot transducer triggers 27** allow the drummer to use more conventional foot play patterns if needed.

Figure 16:
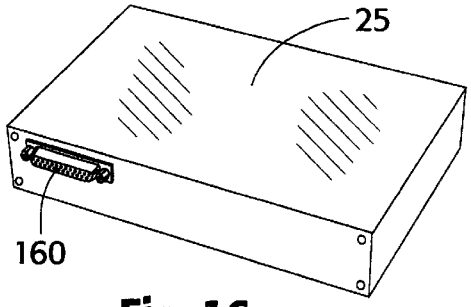
FIG. 16 shows a top front view of a percussion synthesizer interface box of the preferred embodiment of the present invention.
Figure 17:
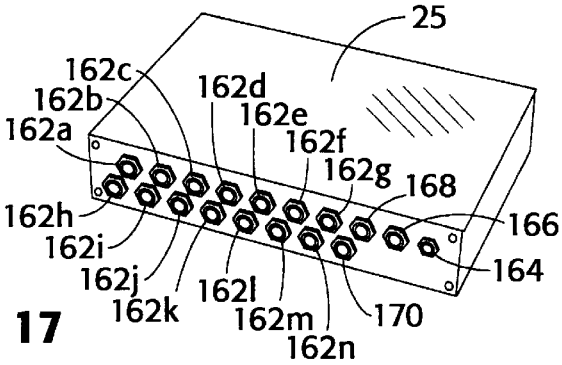
FIG. 17 shows a top rear view of a percussion synthesizer interface box of the preferred embodiment of the present invention.

Percussion synthesizer interface box 25 is shown in FIGS. 16 and 17. It is of common construction known to those familiar in the art. A female cable connector 160 is located on the front for attaching connecting cable 26 as shown in FIG. 1. Internally, wires connect female cable connector 160 directly to a plurality of ¼" 2-conductor phone jacks 162*a*–162*n*, 3-conductor headphone monitor jacks 164 and 166, and ¼" 3-conductor footswitch jack 168 mentioned below.

As shown in FIG. 17, interface box 25 has jacks 162*a*–162*n* on the rear which allow for connection to a percussion synthesizer. These connections are made with common ¼" 2-conductor phone cords 172, shown in FIG. 18, which are common in musical instrument interconnections. This hookup system permits the connection of more than one percussion synthesizer, thus adding to the palette of available sounds.

Figure 18:
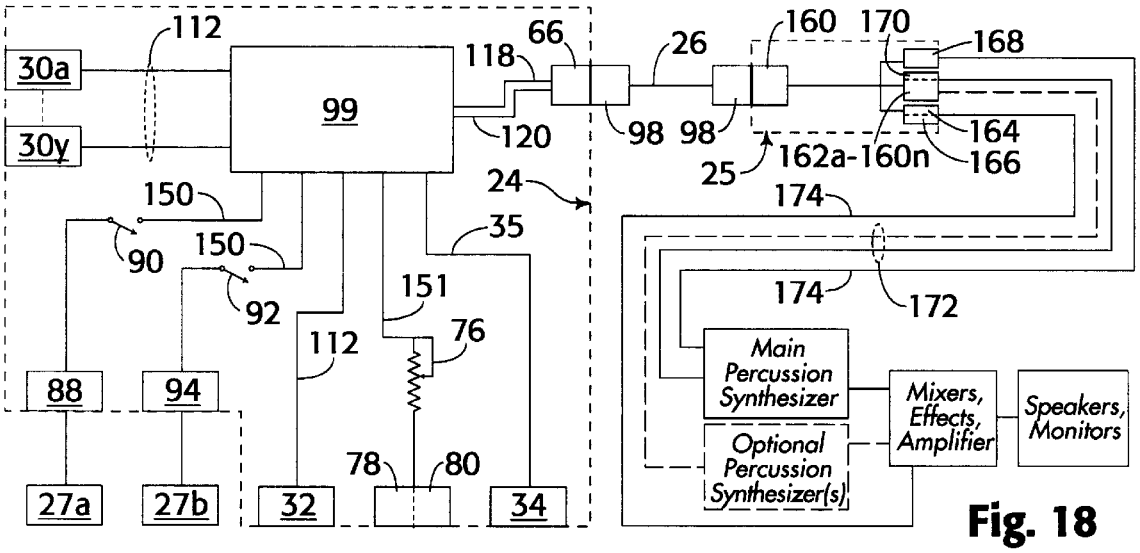
FIG. 18 shows a block diagram of the circuitry of the preferred embodiment of the present invention.

A ⅛" 3-conductor headphone monitor jack 164 and a ¼" 3-conductor headphone monitor jack 166 connect either directly to the percussion synthesizer for percussion-only monitoring, or to a larger studio monitor system where the drummer can hear the entire mix in the headphones, via ¼" 3-conductor phone cord 174 shown in FIG. 18. The two sizes of aforementioned jacks 164 and 166 permit easier hookups without having to search for an adapter, and are wired in parallel.

Jack 168 transfers the signal from percussion synthesizer patch change switch 34 and is connected to the percussion synthesizer via cord 174. ¼" 2-conductor hi-hat control jack 170 transfers the signal from force sensitive resistor transducer trigger 32 and is connected to the percussion synthesizer via cord 172.

The various interconnections the user can make are more clearly seen in FIG. 18. Also shown in this figure are subsequent mixers, effects boxes (a reverb unit, for example), amplifiers and speakers.

OPERATION—FIGS. 19–21

The following discussion assumes that the drummer has already become familiar with their percussion synthesizer, and has programmed the drumset patches to suit their musical intentions.

Before playing of the instrument, the drummer must connect the components. As can be seen in FIGS. 1, 5 and 8, the drummer first attaches male cable connector 98 at one end of connecting cable 26 to female cable connector 66 on instrument body 24. Then the other male connector on connecting cable 26 is attached to female cable connector 160 on percussion synthesizer interface box 25. If the drummer desires, one or two foot transducer triggers 27 can be plugged into the appropriate hi-hat or bass drum jacks on foot transducer connector panel 70, and the proper transducer switches 90 or 92 turned on. Switches 90 or 92 allow the drummer to selectively activate either of two triggers 27.

Next, the drummer needs to connect interface box 25 to a suitable percussion synthesizer. For example, a standard ¼" 2-conductor phone cord 172 would be inserted into ¼" phone jack 162*a*, which represents the bass drum transducer triggers, and the other end would be inserted into one of the jacks on the percussion synthesizer which controls a bass drum sound. Each transducer trigger would thus be connected to the appropriate percussion synthesizer sound. The exact hookup sequence will depend not only on the make of the percussion synthesizer, but the nature of the patches programmed on it as well. Similarly the user would connect the hi-hat control, headphone monitor and footswitch control using the proper cord, as referenced in FIG. 18.

FIGS. 19–21 show basic hand positions for playing the preferred embodiment of the present invention. These figures are drawn without reference numbers for clarity, so it is recommended to refer to FIG. 10 during the following discussion.

In FIG. 19, to play a basic drumset rhythm for rock and roll, for example, the index finger of the left hand would play the snare drum on piezoelectric transducer trigger 30*s*, the thumb of the left hand would play the bass drum on piezoelectric transducer trigger 30*o*, the thumb of the right hand would hold down the hi-hat on force sensitive resistor transducer trigger 32, and the index finger of the right hand would play a currently closed hi-hat on piezoelectric transducer trigger 30*d*. If a more open hi-hat sound were desired, the user would release the thumb pressure on force sensitive resistor transducer trigger 32 until the proper sound was achieved. The drummer is standing and using a shoulder strap in this drawing.

FIG. 20 shows hand positions for two different actions. To play a full snare drum sound backed up with a softer high tom-tom sound the drummer would strike fully the index finger of the left hand on piezoelectric transducer trigger 30*s* and strike partially the middle finger of the left hand on piezoelectric transducer trigger 30*w*. The right hand index finger is causing a particular miscellaneous percussion sound by striking piezoelectric transducer trigger 30*f*, while the right hand thumb has remained on force sensitive resistor transducer trigger 32 merely to maintain hand position for eventual return to the normal position. The drummer is sitting with the present invention resting on their lap in this drawing, but they also could rest the instrument on a table top or other convenient flat surface.

If the drummer so desired, it would be possible to play an entire standard drumset with one hand, but would require a great deal of practice to do so proficiently.

FIG. 21 shows the right hand in a normal playing position, and the left hand changing the percussion synthesizer patch by pushing percussion synthesizer patch change switch 34.

The above description of hand positions and movements should not be construed as limitations of the present invention, but as examples of how its ergonomic design allows a versatile use of a percussion synthesizer. As with any musical instrument, skill, agility and speed will increase with familiarity and practice, as will the benefits of the present invention.

CONCLUSION, RAMIFICATIONS AND SCOPE

Accordingly, it can be seen that the percussion trigger instrument of this invention provides a way to produce realistic percussion sounds which is comfortably and rapidly playable with one or two hands, which allows playing numerous percussion sounds at the same time, and can be used comfortably in a sitting or standing position. Furthermore, this instrument provides a method for direct connection to one or more percussion synthesizers, is internally configurable to suit the playing patterns of the user, allows replacement or switching of the triggers, and reduces crosstalk between triggers. Still furthermore, the present invention has optional foot controls, can select percussion synthesizer patches, can control a hi-hat sound, and a headphone monitor can be plugged directly into the instrument.

Although the above description contains many details, these should not be viewed as limiting the scope of the invention but as merely providing illustrations of some of the presently preferred embodiments of this invention. Following are several areas in which other shapes or materials could be used.

The body itself could be made of a number of materials such as machined or molded wood, plastic, or lightweight metal. The shape of the body could be any shape which allows placement of both hands over a plurality of trigger groups. The present embodiment could be produced in a left-hand, or mirrored model.

The orientation of the head of the present embodiment could be varied with respect to the body, including changing the rotation angle of the head, which is in the vicinity of 90° in the current embodiment.

The material for the caps of the triggers could be molded or machined from any material which conducts vibration efficiently, and could be colored, color-coded, adorned, textured or patterned for decoration or for ease of learning to play patterns. The caps could be shaped differently than circular domes, such as hexagons, or have a different cross-section.

The trigger arrangement and pattern could have additions or subtractions. The triggers could be angled to facilitate play. In addition, this trigger arrangement could be used for other musical instruments, computer input devices or to control mechanical devices.

Other embodiments could include a different type of connecting cable and interface box, the addition of a small on-board MIDI computer to translate trigger voltages into specific MIDI notes which a MIDI-equipped synthesizer could understand, and the addition of a microphone jack for a headset microphone for even more freedom of movement while performing.

Thus the scope of the invention should be determined by the appended claims and their legal equivalent, rather than by the examples given.

What is claimed is:

1. A musical instrument for triggering a percussion synthesizer, comprising:

a hand held housing having at least first and second front surfaces in which said first and second front surfaces are connected by a neck which has a twist of about 90 degrees, resulting in the orientation of said first surface relative to said second surface to be about 90 degrees;

a plurality of trigger transducers disposed on said first and second front surfaces, each of said trigger transducers producing an electrical impulse in response to striking by fingers of a player against said trigger transducers;

a grouping of said trigger transducers on each of said surfaces which each of said groupings produces sounds including at least a bass drum sound, a snare drum sound, a high tom-tom sound, a medium tom-tom sound, a low tom-tom sound, a hi-hat cymbal sound, a ride cymbal sound, a ride cymbal bell sound, a crash cymbal sound, and a plurality of miscellaneous percussion sounds; and a routing means for said plurality of trigger transducers to connect to said percussion synthesizer through a connection means with which to change the assignment of said sounds within each of said grouping of said trigger transducers.

2. The instrument of claim 1 further including at least one pressure sensitive transducer which is used to activate a hi-hat sound control on said percussion synthesizer.

3. The instrument of claim 2 wherein each of said pressure sensitive transducers includes a force sensitive resistor.

4. The instrument of claim 1 further including means for connecting a plurality of foot operated trigger transducers to activate said sounds on said percussion synthesizer, which include at least said bass drum sound and said hi-hat sound control for said percussion synthesizer.

5. The instrument of claim 1 further including means for connecting a headphone monitor to said percussion synthesizer.

6. The instrument of claim 5 wherein said means for connecting a headphone monitor includes jacks for both ¼" and ⅛" plugs.

7. The instrument of claim 1 further including switching means for scrolling a percussion patch feature on said percussion synthesizer.

8. The instrument of claim 1 wherein each of said trigger transducers includes an outer covering of rigid material which transmits the striking force of said fingers of player through said outer covering to said trigger transducer.

9. The instrument of claim 1 wherein changing the assignment of said sounds within each of said grouping of said trigger transducers uses a switchboard means.

10. The instrument of claim 9 wherein said switchboard means includes means for plugging and unplugging said connection means.

11. A musical instrument for triggering a percussion synthesizer, comprising:

a hand held housing having at least first and second front surfaces in which first and second front surfaces are rotated approximately 90 degrees relative to each other along the longitudinal axis of said hand held housing;

an arrangement of a plurality of trigger transducers on each of said surfaces arranged in a closest packing pattern corresponding to said player's fingers, which activates sounds on said percussion synthesizer, and which includes on each of said arrangements at least a bass drum sound, a snare drum sound, a plurality of tom-tom sounds, a plurality of cymbal sounds and a plurality of miscellaneous percussion sounds; and a means of connecting said plurality of trigger transducers to said percussion synthesizer with a plurality of electrical connections so that each of said trigger transducers activates said sounds from said percussion synthesizer, through means to physically alter the arrangement of said plurality of electrical connections and therefore said sounds that said plurality of electrical connections represent.

12. The instrument of claim 11 further including at least one pressure sensitive resistor which is used to activate a hi-hat sound control on said percussion synthesizer.

13. The instrument of claim 11 further including means for connecting a plurality of foot operated trigger transducers to activate said sounds on said percussion synthesizer, which include at least said bass drum sound and said hi-hat sound control for said percussion synthesizer.

14. The instrument of claim 11 wherein each of said trigger transducers includes an outer cap of vibration transmitting material which transmit; the urging force of said player's fingers through said outer cap to said trigger transducer through an adhesive binding together said outer cap to said trigger transducer.

* * * * *